US006474031B2

(12) United States Patent
Phillips

(10) Patent No.: US 6,474,031 B2
(45) Date of Patent: Nov. 5, 2002

(54) WEEPHOLE DRAINAGE AID AND PEST BARRIER

(76) Inventor: Dale Phillips, 31414 Sherrie La., Magnolia, TX (US) 77354

( * ) Notice: Subject to any disclaimer, the term of this patent is extended or adjusted under 35 U.S.C. 154(b) by 0 days.

(21) Appl. No.: 09/800,486

(22) Filed: Mar. 8, 2001

(65) Prior Publication Data

US 2001/0023564 A1 Sep. 27, 2001

Related U.S. Application Data

(60) Provisional application No. 60/187,818, filed on Mar. 8, 2000.

(51) Int. Cl.[7] ..... E04B 1/70; E04F 17/04

(52) U.S. Cl. ..... 52/302.1; 52/169.5; 52/101; 52/302.6; 52/310; 52/396.04

(58) Field of Search ..... 52/97, 169.5, 101, 52/302.1, 302.3, 302.6, 310, 396.08, 747.1, 745.09

(56) References Cited

U.S. PATENT DOCUMENTS

| | | | | | |
|---|---|---|---|---|---|
| 2,934,931 | A | * | 5/1960 | Johnson | 52/302.3 |
| 3,429,084 | A | * | 2/1969 | Brewer | 52/101 |
| 4,102,093 | A | | 7/1978 | Harris | |
| 4,282,691 | A | | 8/1981 | Risdon | |
| 4,587,891 | A | | 5/1986 | Kruse | |
| 5,203,795 | A | | 4/1993 | Balamut et al. | |
| D372,068 | S | | 7/1996 | Disanto | |
| 5,870,864 | A | * | 2/1999 | Snyder et al. | 52/169.5 |
| 6,044,594 | A | * | 4/2000 | Desselle | 52/101 |
| 6,105,323 | A | * | 8/2000 | Paulle | 52/302.1 |
| 6,176,048 | B1 | * | 1/2001 | Berger | 52/101 |

FOREIGN PATENT DOCUMENTS

| | | | | |
|---|---|---|---|---|
| GB | 2173837 | A | * 10/1986 | E04B/1/70 |
| GB | 2231889 | A | * 11/1990 | E04B/1/70 |

* cited by examiner

*Primary Examiner*—Carl D. Friedman
*Assistant Examiner*—Brian E. Glessner
(74) *Attorney, Agent, or Firm*—Shawn Hunter; Bracewell & Patterson, LLP

(57) ABSTRACT

Devices and methods for protecting weepholes in brick veneer structures against insects and other pests while still allowing drainage and for helping prevent mortar portions and other objects from blocking the weepholes. A weephole device is described that includes a substantially vertical spacer portion having a pair of side walls that are maintained in a spaced relation to one another to define a gap for the passage of water or other fluids. The spacer portion is shaped and sized to be inserted into a weephole space between a pair of bricks. A tray is affixed to the spacer portion and includes a substantially horizontally disposed tray portion that is shaped and sized to capture falling mortar portions or other objects that might block the weephole were they to fall behind it within the air gap between the brick veneer wall and the structural inner wall. The rear edge of the tray portion has an edge that is intended to contact the inner wall when the weephole device is emplaced. In preferred embodiments described herein, the edge is upturned.

13 Claims, 2 Drawing Sheets

WEEPHOLE DRAINAGE AID AND PEST BARRIER

CROSS-REFERENCE TO RELATED APPLICATIONS

The present application claims the priority of U.S. Provisional Patent Application Serial No. 60/187,818 filed Mar. 8, 2000.

BACKGROUND OF THE INVENTION

1. Field of the Invention

The invention relates to devices and methods to provide an improved weephole arrangement for buildings, homes and other structures.

2. Description of the Related Art

Weepholes are gaps or spaces that are intentionally left between adjacent bricks in a home, building or other structures. Weepholes are traditionally placed at intervals within the lowest row of bricks on the outside of the structure. They are most often used in structures having a "brick veneer" wherein an outer brick wall is separated by an air gap from the walls of the interior structure. Weepholes are intended to permit drainage of water that becomes trapped in the air gap. They also allow ventilation so that air can reach the walls of the interior structures, thereby helping to prevent rot.

There are several problems associated with conventional weepholes. First, insects and other pests can easily enter the weepholes and construct nests within the air gap or infest the structure itself. Secondly, objects, mud or debris that enters the weephole from outside the structure can block the weephole and make it unable to drain water. Such blockages are not often easy to see or clear out. Third, a weephole may become blocked at the inner end of its opening during construction of the brick wall. Mortar that is troweled off of the bricks as upper rows of bricks are laid may fall or run down the inside of the wall to block, or partly block, the weephole. Again, the weephole becomes ineffective.

SUMMARY OF THE INVENTION

Devices and methods are described for protecting weepholes in brick veneer structures against insects and other pests while still allowing drainage. In addition, the invention helps prevent mortar portions and other objects from blocking the weepholes. A weephole device is described that includes a substantially vertical spacer portion having a pair of side walls that are maintained in a spaced relation to one another to define a gap for the passage of water or other fluids. The spacer portion is shaped and sized to be inserted into a weephole space between a pair of bricks. A tray is affixed to the spacer portion and includes a substantially horizontally disposed tray portion that is shaped and sized to capture falling mortar portions or other objects that might block the weephole were they to fall behind it within the air gap between the brick veneer wall and the structural inner wall. The rear edge of the tray portion has an edge that is intended to contact the inner wall when the weephole device is emplaced. In preferred embodiments described herein, the edge is upturned.

DETAILED DESCRIPTION OF THE PREFERRED EMBODIMENTS

Figure 1:
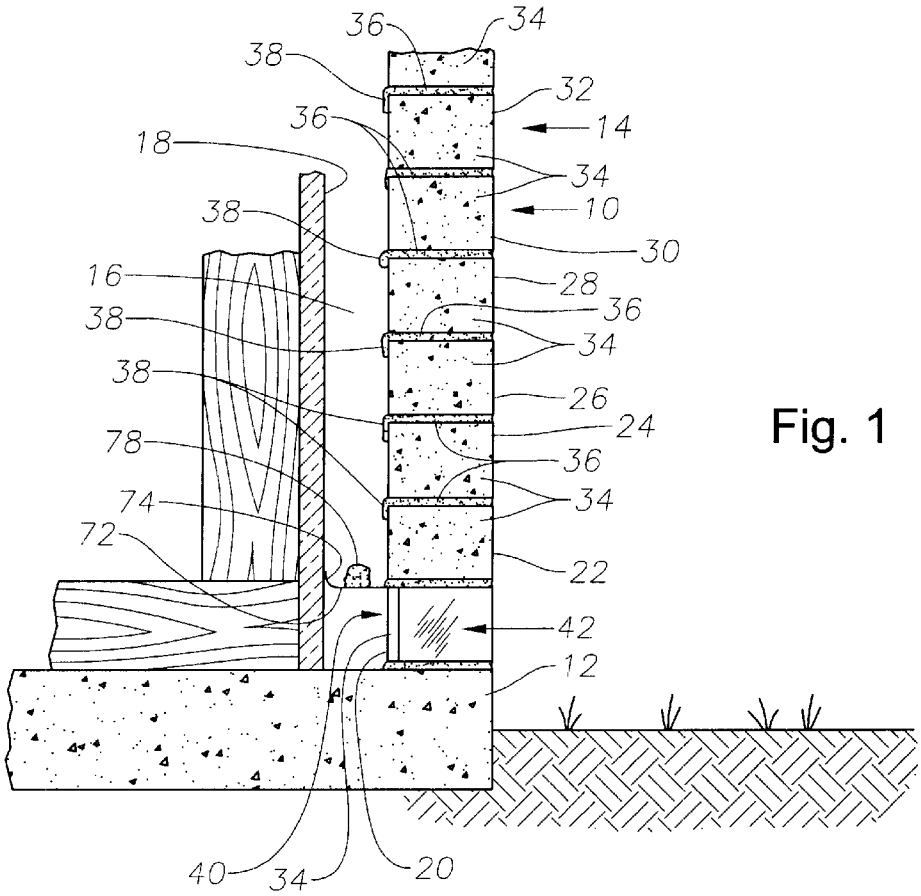
FIG. 1 is a side cross-sectional view of the wall of a structure having a brick veneer construction incorporating an exemplary weephole device constructed in accordance with the present invention.

FIG. 1 depicts a portion of a structure 10 that has a brick veneer. The structure 10 has a concrete foundation pad 12 upon which the structure 10 is supported. A brick wall 14 is shown disposed on the pad 12 and separated by an air gap 16 from inner wall 18. The inner wall 18 is typically constructed of lumber, dry wall and the like. As a result, it is desired to protect the inner wall 18 from moisture.

The brick wall 14 is constructed of several rows 20, 22, 24, 26, 28, 30 and 32 of bricks 34 that are secured together by lines of mortar 36. It is noted that several of the lines of mortar 36 have excess mortar portions 38 on the inside surface of the wall 14. These mortar portions 38 represent loose mortar remaining from laying of the brick wall 14.

Figure 3:
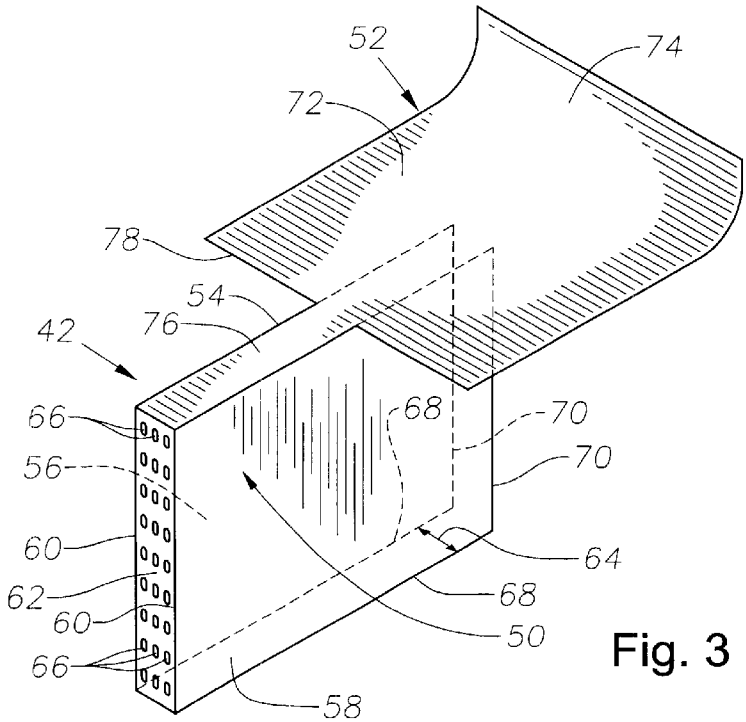
FIG. 3 is an isometric view of an exemplary weephole device shown apart from the structure 10.

The lowest row 20 of bricks 34 incorporates a plurality of weepholes, only one of which is illustrated at 40. The weepholes 40 each include a weephole device 42, the construction of which can be appreciated with reference to FIG. 1 as well as FIGS. 2 and 3.

Figure 2:
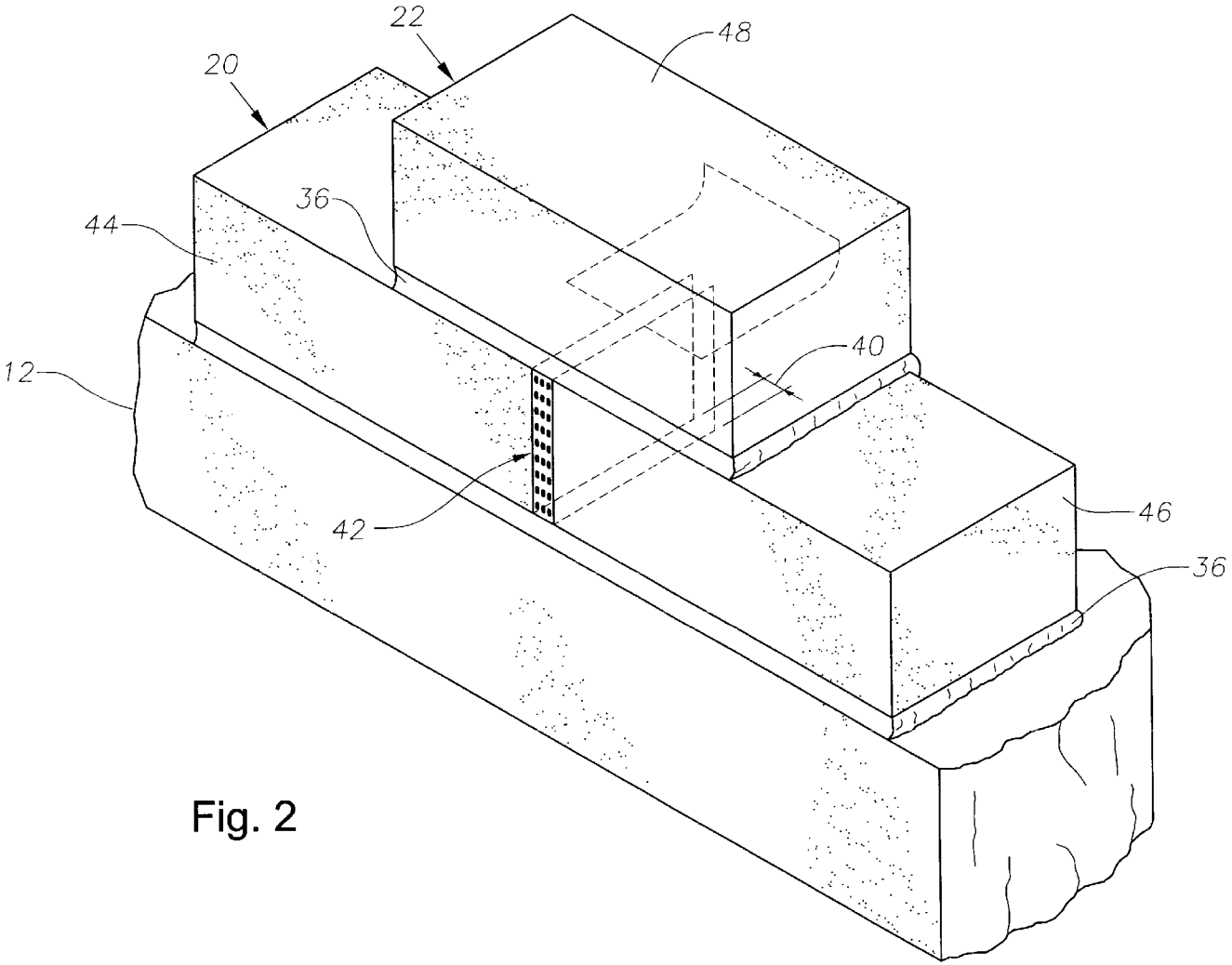
FIG. 2 is an isometric of a portion of a brick wall illustrating, partially in phantom, placement of the exemplary weephole device between adjacent bricks.

FIG. 2 shows adjacent bricks 44 and 46 within the lowest row 20 of the wall 14. Weephole gap 40 is disposed between the adjacent bricks 44, 46. Brick 48 is shown from the row 22 of bricks above the lowest row 20. For clarity, no mortar is illustrated in FIG. 2.

The weephole device 42 includes a vertically oriented spacer portion 50 and a horizontal tray 52 that is affixed to the upper end 54 of the spacer portion 50. The weephole device 34 may be fashioned of metal, a durable plastic or another suitable durable material.

The spacer portion 50 of the device 42 is substantially rectangular and formed of a pair of side walls 56, 58 that are affixed in a spaced relation from one another along front edges 60 by front plate 62. Currently preferred dimensions for the side plates are 3½" in length × 2½" in height. A gap 64 is provided between the side walls 56, 58. It is currently preferred that the gap 64 be approximately ⅜". The front plate 62 is perforated by apertures 66. The lower edges 68 and rear edges 70 of the side walls 56, 58 are preferably not affixed to one another.

The tray 52 has a substantially rectangular and flat tray portion 72 with an upturned rear edge 74. The tray portion 72 is preferably 3" in length ×3" in width. A horizontal plate 76 of reduced width extends forwardly from the front edge 78 of the tray portion 72 to adjoin the front plate 62. The horizontal plate 76 is also secured to the upper end 54 of the side walls 56, 58. It is currently preferred that the length of the horizontal plate 76 as measured from the front plate 62 to the forward edge 78 of the tray portion 72 be approximately 2".

The weephole device 42 is installed as the brick wall 14 is being constructed. At a location where it is desired to add a weephole, the gap such as gap 40 is left between adjacent bricks, such as is shown between bricks 44 and 46 in FIG. 2. The spacer portion 50 of a weephole device 42 is placed into the gap 40. It is preferred that the side walls 56, 58 of the spacer portion 50 contact the adjacent bricks 44, 46 in a tight fitting manner, so that no separation remains between brick and side wall. The horizontal plate 76 should be made level with or be located slightly below, the top surfaces of the adjacent bricks 44, 46. It is noted that, when the weephole device 42 is emplaced in this manner, the upturned edge 74 of the tray 52 engages the inner wall 18 of the structure 10 as shown in FIG. 1. If the length of the tray 52 is greater than the air gap 16, portions of the upturned edge 74 may be trimmed away to accommodate the device 42. As the second layer, or row, 22 of bricks is placed, brick 48 is placed atop and mortared onto the plate 76 and part of tray portion 72 of the weephole device 42.

In operation, the tray portion 72 of the device 42 prevents mortar portions 38 or other objects from falling down to block the inner opening of the weephole 40. These objects, such as the fallen mortar portions 78 shown in FIG. 1, are instead captured atop the tray portion 72. Because the tray 52 has a width that extends laterally beyond either side of the weephole gap 40, the weephole device 42 will be effective to prevent blockages from occurring on either side of the weephole gap 40 as well.

The presence of the front plate 62 precludes insects or other pests from entering the weephole gap 16 from outside of the structure 10. At the same time, the apertures 66 permit water and air to pass through the weephole gap 40. Because the front plate 62 is generally flush with the outer surfaces of adjacent bricks 44, 46, it is easily visible and cleaned.

While the invention has been described with reference to preferred embodiments it will be apparent to those skilled in the art that it is not limited to that which is described herein. This application is intended to cover any modifications or changes as may come within the scope of the following claims.

What is claimed is:

1. A weephole device to be disposed within a weephole of a brick veneer wall, the device comprising:

a substantially vertically-disposed spacer portion having a pair of substantially parallel side walls in fixed, spaced relation to one another;

a front plate affixed to the spacer portion containing at least one aperture therein for transmission of liquid therethrough; and a tray affixed to an upper end of the spacer portion and substantially horizontally disposed with respect to the spacer portion between the substantially parallel sidewalls.

2. The weephole device of claim 1 wherein the tray comprises a tray portion extending rearwardly of the spacer portion for capturing mortar portions and other objects.

3. The weephole device of claim 2 wherein the tray portion further comprises an upturned rear edge for contacting an inner wall of a structure.

4. The weephole device of claim 1 wherein the tray further comprises a reduced width horizontal plate that adjoins the front plate.

5. The weephole device of claim 1 wherein the device is fashioned from metal.

6. The weephole device of claim 1 wherein the device is fashioned from plastic.

7. A weephole device to be disposed within a weephole of a brick wall, the device comprising:

a substantially vertically-disposed spacer portion having a pair of substantially parallel side walls in fixed, spaced relation to one another to define a gap therebetween;

a tray that is affixed to an upper end of the spacer portion and substantially horizontally disposed with respect to the spacer portion between the substantially parallel sidewalls; and a front plate affixed to each of the side walls and having a plurality of apertures therein for drainage of liquid.

8. The weephole device of claim 7 wherein the tray portion comprises:

a reduced width horizontal plate portion secured to the spacer portion; and a tray portion having a width greater than the horizontal plate portion and extending rearwardly from the spacer portion.

9. The weephole device of claim 7 wherein the gap is approximately ⅜ inches in width.

10. The weephole device of claim 7 wherein each of the side walls is rectangular.

11. A weephole device to be disposed within a weephole of a brick veneer wall, the device comprising:

a pair of substantially parallel, vertical side walls in fixed, spaced relation to one another, each of the side walls presenting a front edge;

a front plate that is secured to each of the side walls along its front edge, a plurality of apertures disposed through the front plate for transmission of liquid therethrough; and a substantially horizontally disposed tray portion affixed to an upper end of each of the side walls and extending between and rearwardly of the sidewalls.

12. The weephole device of claim 11 wherein the tray portion has a greater width than the front plate.

13. The weephole device of claim 11 wherein the tray portion further comprises an upturned rear edge for contacting the inner wall of a structure.

* * * * *